US010388507B2

(12) United States Patent
Mizutani

(10) Patent No.: US 10,388,507 B2
(45) Date of Patent: Aug. 20, 2019

(54) TIME-OF-FLIGHT MASS SPECTROMETER

(71) Applicant: SHIMADZU CORPORATION, Kyoto-shi, Kyoto (JP)

(72) Inventor: Shiro Mizutani, Kyoto (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 16/069,214

(22) PCT Filed: Jan. 12, 2016

(86) PCT No.: PCT/JP2016/050704
§ 371 (c)(1),
(2) Date: Jul. 11, 2018

(87) PCT Pub. No.: WO2017/122276
PCT Pub. Date: Jul. 20, 2017

(65) Prior Publication Data

US 2019/0006168 A1 Jan. 3, 2019

(51) Int. Cl.

| | |
|---|---|
| ***H01J 49/40*** | (2006.01) |
| ***H01J 49/02*** | (2006.01) |
| ***H01J 49/10*** | (2006.01) |

(52) U.S. Cl.
CPC ..... *H01J 49/40* (2013.01); *H01J 49/022* (2013.01); *H01J 49/10* (2013.01)

(58) Field of Classification Search
CPC ..... H01J 49/40; H01J 49/10; H01J 49/022
(Continued)

(56) References Cited

U.S. PATENT DOCUMENTS

| | | | |
|---|---|---|---|
| 4,511,815 | A | 4/1985 | Wood |
| 5,304,863 | A | 4/1994 | Cargille |

(Continued)

FOREIGN PATENT DOCUMENTS

| | | | |
|---|---|---|---|
| DE | 36 30 775 | C2 | 3/1988 |
| JP | 5-304451 | A | 11/1993 |
| JP | 2001-283767 | A | 10/2001 |

OTHER PUBLICATIONS

International Search Report for PCT/JP2016/050704 dated Apr. 19, 2016 [PCT/ISA/210].

*Primary Examiner* — Michael Maskell
(74) *Attorney, Agent, or Firm* — Sughrue Mion, PLLC

(57) ABSTRACT

An acceleration voltage generator (7) generates a high-voltage pulse to be applied to a push-out electrode (11), by operating a switch section (74) to turn on and off a high direct-current voltage generated by a high-voltage power supply (75). A drive pulse signal is supplied from a controller (6) to the switch section (74) through a primary-side drive section (71), transformer (72), and secondary-side drive section (73). The measurement period of a repeated measurement is changed according to a target m/z range. A primary-voltage controller (61) controls a primary-side power supply (76) to change a primary-side voltage according to the measurement period, thereby adjusting the voltage to be applied between the two ends of a primary winding of the transformer (72) by the primary-side drive section (71). The pulse signal fed to the switch section (74) overshoots due to LC resonance. Due to this overshoot, the voltage at the point in time where the pulse signal begins to rise varies depending on the measurement period. Such a variation of the voltage at the point in time where the pulse signal begins to rise causes a discrepancy in the timing at which the rising slope crosses the threshold voltage of MOSFET. However, this discrepancy can be corrected by adjusting the primary- (Continued)

side voltage. As a result, high mass accuracy can be achieved irrespective of the measurement period.

3 Claims, 8 Drawing Sheets

(58) Field of Classification Search
USPC ..... 250/281, 282, 287, 288
See application file for complete search history.

(56) References Cited

U.S. PATENT DOCUMENTS

| | | | | |
|---|---|---|---|---|
| 2009/0230297 | A1* | 9/2009 | Mizutani | H01J 49/022 250/281 |
| 2014/0326873 | A1* | 11/2014 | Kokubo | H01J 49/022 250/288 |

* cited by examiner

Fig. 1
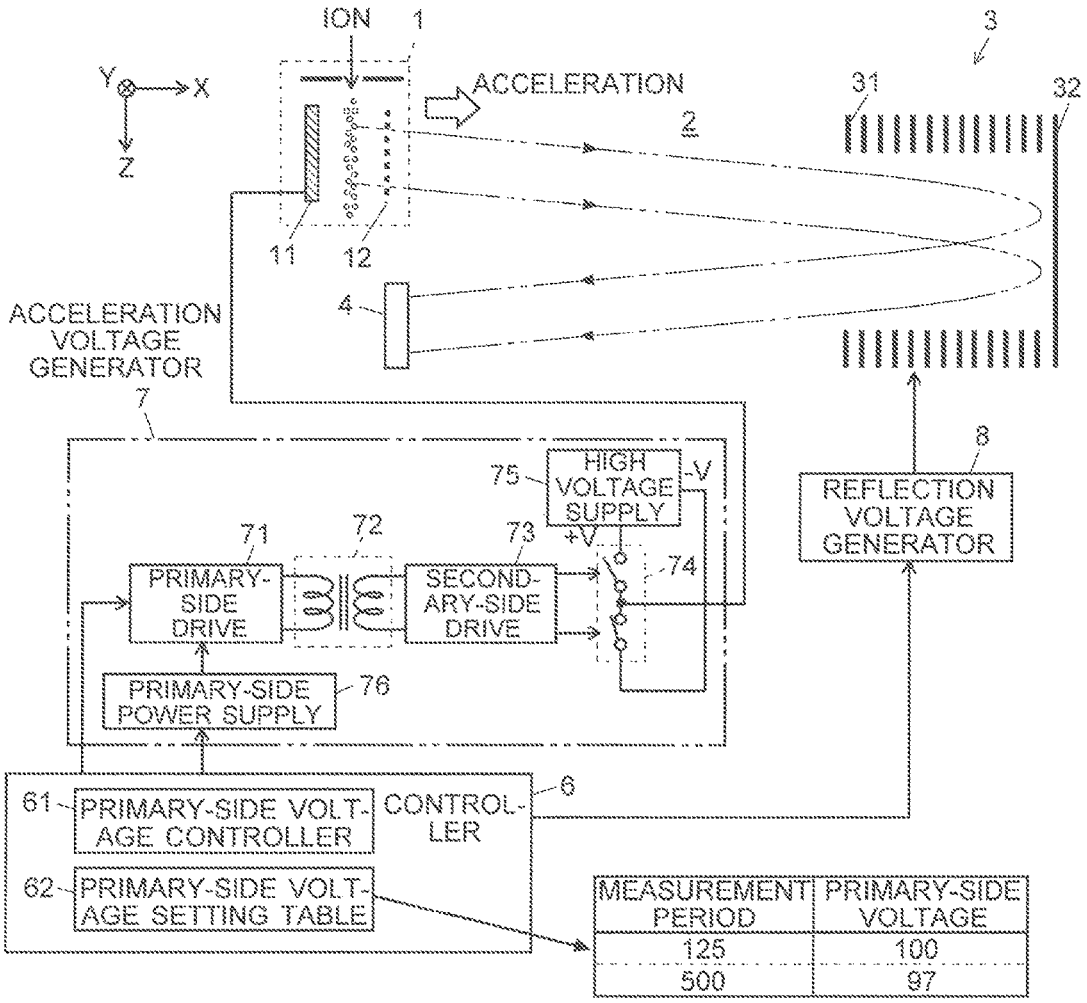
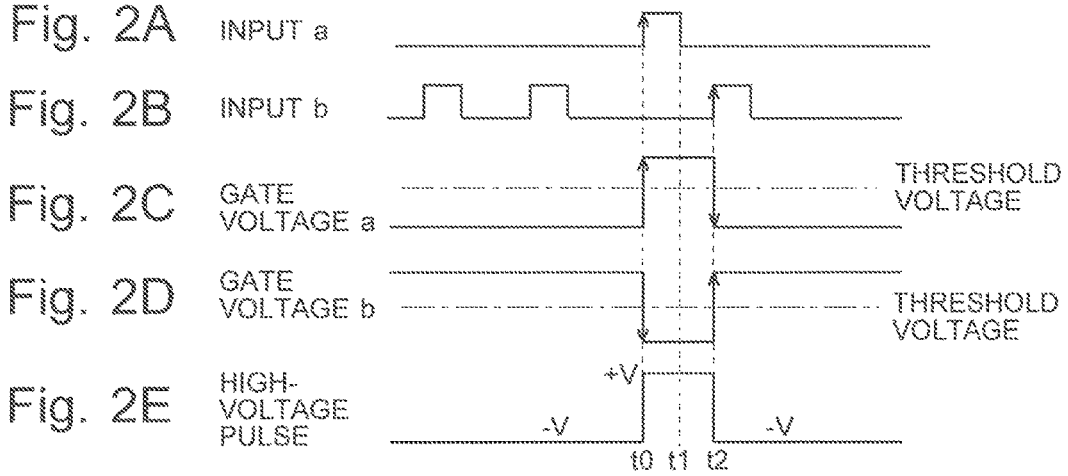

TIME-OF-FLIGHT MASS SPECTROMETER

CROSS REFERENCE TO RELATED APPLICATIONS

This application is a National Stage of International Application No. PCT/JP2016/050704, filed on Jan. 12, 2016.

TECHNICAL FIELD

The present invention relates to a time-of-flight mass spectrometer. More specifically, the present invention relates to a time-of-flight mass spectrometer which periodically repeats a measurement operation in which ions ejected from an ion ejector are detected after flying in a flight space.

BACKGROUND ART

In a time-of-flight mass spectrometer (TOFMS), various ions derived from a sample are ejected from an ion ejector, and the time of flight required for each ion to fly a certain flight distance is measured. Each ion flies at a speed according to its mass-to-charge ratio m/z. Accordingly, the above-mentioned time of flight corresponds to the mass-to-charge ratio of the ion, and the mass-to-charge ratio of the ion can be obtained based on its time of flight.

FIG. 14 is a schematic configuration diagram of a typical orthogonal acceleration TOFMS (hereinafter, it may be referred to as "OA-TOFMS").

In FIG. 14, ions generated from a sample in an ion source (not shown) are introduced into an ion ejector 1 in the Z-axis direction, as shown by an arrow in FIG. 14. The ion ejector 1 includes a plate-shaped push-out electrode 11 and a grid-shaped extraction electrode 12, which are arranged to face each other. Based on control signals from a controller 6, an acceleration voltage generator 7 applies a predetermined level of high-voltage pulse to either the push-out electrode 11 or the extraction electrode 12, or between them, at a predetermined timing. By this operation, ions passing through the space between the push-out electrode 11 and the extraction electrode 12 are given acceleration energy in the X-axis direction and ejected from the ion ejector 1 into a flight space 2. The ions fly through the flight space 2 which has no electric field, and then enter a reflector 3.

The reflector 3 includes a plurality of annular reflection electrodes 31 and a back plate 32. A predetermined direct voltage is applied to each of the reflection electrodes 31 and the back plate 32 from a reflection voltage generator 8. A reflective electric field is thereby formed within the space surrounded by the reflection electrodes 31. The ions are reflected by this electric field, and once more fly through the flight space 2, to eventually reach a detector 4. The detector 4 generates ion-intensity signals according to the amount of ions that have reached the detector 4, and sends those signals to a data processor 5. The data processor 5 prepares a time-of-flight spectrum that shows the relationship between the time of flight and the ion-intensity signal, with the point in time of the ejection of the ions from the ion ejector 1 defined as the time-of-flight value of zero, and converts the time of flight to mass-to-charge ratio based on prepared mass calibration information, so as to calculate a mass spectrum.

When ions are to be ejected from the ion ejector 1 of the above-mentioned OA-TOFMS, a high-voltage pulse on the order of kV with a short duration needs to be applied to the push-out electrode 11 and the extraction electrode 12. For generating such a high-voltage pulse, a power supply device as disclosed in Patent Literature 1 (it is referred to as a "pulsar power source" in this document) has been conventionally used.

The power supply device includes: a pulse generator for generating a pulse signal for controlling the timing of the generation of the high-voltage pulse; a pulse transformer for transmitting the pulse signal from a control-system circuit to a power-system circuit while electrically insulating the control circuit that operates with a low voltage from the power circuit that operates with a high voltage; a driving circuit connected to the secondary winding of the transformer; a high-voltage circuit for generating a high direct-current voltage, and a switching element employing metal-oxide-semiconductor field-effect transistors (MOSFET) to generate a voltage pulse by turning on and off the direct-current voltage generated by the high-voltage circuit according to a control voltage provided through the driving circuit. Such circuits are not limited to TOFMSs; they are commonly used for generating high-voltage pulses (see Patent Literatures 2, 3, and others).

In an LC-TOFMS in which a liquid chromatograph (LC) is provided in the previous stage of the OA-TOFMS that includes an atmospheric pressure ion source, such as an electrospray ion source, it is necessary to detect, without omission, various substances contained in a sample liquid continuously introduced into the atmospheric pressure ion source of the TOFMS from the exit port of the column in the LC. To this end, a measurement operation that covers a predetermined length of time is repeatedly performed with a predetermined period in the TOFMS. The longer the repetition period of the measurement is, the wider the time interval becomes between the measurement points on a chromatogram to be created. This lowers the accuracy of the shape of a peak waveform of a target substance and deteriorates the performance of the quantitative measurement. For minimizing the time interval between the measurement points on the chromatogram, it has been common to control the device so that a relatively short measurement period is set in a measurement of ions that have low mass-to-charge ratios and short times of flight, while a relatively long measurement period is set in a measurement of ions that have high mass-to-charge ratios and long times of flight.

For example, the control is performed in such a manner that the measurement period is set to 125 [μs] for ions with low mass-to-charge ratios within a range of m/z 2000 or less, to 250 [μs] for ions with medium mass-to-charge ratios within a range of m/z 2000 to 10000, and to 500 [μs] for ions with high mass-to-charge ratios within a range of m/z 10000 to 40000.

Such a change in the measurement period can be achieved by changing the time interval of the generation of the high-voltage pulse to be applied to the push-out electrode 11 and the extraction electrode 12 of the ion ejector 1. In other words, even when the measurement period is changed, parameters other than the time interval of the generation of the high-voltage pulse, such as a pulse width (pulse application period), are unchanged irrespective of the measurement period.

In a power supply device for generating a high-voltage pulse as mentioned above, a slight delay in time inevitably occurs between the point in time of the rising of the pulse signal fed to the pulse transformer and the point in time of the rising of the high-voltage pulse outputted from the power supply device. In principle, the delay in time should be constant and unaffected by the measurement period as long as the voltage value (pulse height) of the high-voltage pulse is the same. However, the present inventor has found that a temporal fluctuation occurs in the rising of the high-voltage pulse generated by the power supply device in a conventional OA-TOFMS when the measurement period is changed.

In TOFMS, the time of flight of each ion is measured from the point in time where the ion is ejected or accelerated. Accordingly, in order to enhance the accuracy in the measurement of the mass-to-charge ratio, the point in time of the initiation of the time-of-flight measurement needs to coincide with the timing of the actual application of the high-voltage pulse to the push-out electrode or the like as much as possible. If the aforementioned temporal fluctuation occurs in the rising of the high-voltage pulse due to the change in the measurement period, the temporal fluctuation causes a time discrepancy between the point in time of the initiation of the measurement and that of the ejection of the ion. This discrepancy causes a corresponding time-of-flight difference among ions having the same mass-to-charge ratio, and a mass discrepancy occurs. Accordingly, changing the measurement period deteriorates mass accuracy. To avoid this deterioration, mass calibration information that shows a correspondence relationship between the time of flight and the accurate mass-to-charge ratio may be used for each of the different measurement periods for the conversion of the time of flight into mass-to-charge ratio. Preparation of the mass compensation information requires an actual measurement of a standard sample containing a substance having an accurately known mass-to-charge ratio. Therefore, preparing mass compensation information for every measurement period is an extremely troublesome and time-consuming job.

CITATION LIST

Patent Literature

Patent Literature 1: JP 2001-283767 A
Patent Literature 2: JP H5-304451 A
Patent Literature 3: U.S. Pat. No. 4,511,815 B

SUMMARY OF INVENTION

Technical Problem

The present invention has been developed to solve the above problems. An object of the present invention is to provide a time-of-flight mass spectrometer in which the time discrepancy between the point in time of the initiation of the time-of-flight measurement and that of the ejection of ions is reduced so that a high level of mass accuracy can be achieved without being influenced by the measurement period even when the measurement period of the repeated measurement is changed.

Solution to Problem

The present invention developed for solving the above problems is a time-of-flight mass spectrometer which repeats a measurement covering a predetermined time-of-flight range with a predetermined period, the time-of-flight mass spectrometer including:

a) an ion ejector for ejecting ions to be analyzed into a flight space by imparting acceleration energy to the ions by an effect of an electric field created by a voltage applied to an electrode:

b) a high-voltage pulse generator for applying, to the electrode of the ion ejector, a high-voltage pulse for ejecting ions, the high-voltage pulse generator including: a direct-current power supply for generating a high direct-current voltage; a transformer including a primary winding and a secondary winding; a primary-side drive circuit section for supplying drive current to the primary winding of the transformer in response to an input of a pulse signal for ejecting ions; a secondary-side drive circuit section connected to the secondary winding of the transformer; a switching element to be driven by the secondary-side drive circuit section to turn on and off for generating a voltage pulse from the high direct-current voltage generated by the direct-current power supply; and a primary-side power supply for generating a voltage to be applied between the two ends of the primary winding of the transformer through the primary-side drive circuit section; and c) a controller for controlling the primary-side power supply to change the voltage to be applied between the two ends of the primary winding of the transformer in the high-voltage pulse generator, according to the measurement period of a measurement to be performed.

The present inventor has experimentally found that the temporal fluctuation of the rising of the high-voltage pulse associated with the change in the measurement period is caused by a mechanism as follows: In the time-of-flight mass spectrometer according to the present invention, when a pulse signal is fed to the primary-side drive circuit section of the high-voltage pulse generator to eject ions from the ion ejector, the pulse signal is applied to a control terminal of the switching element (e.g. the gate terminal in a MOSFET) through the transformer and the secondary-side drive circuit section. Then, an overshoot of the pulse signal occurs due to a resonance circuit which is mainly composed of the leakage inductance of the transformer and the input capacitance of the control terminal of the switching element. The voltage (absolute value) which has overshot gradually decreases with the passage of time.

The measurement period is normally shorter than the time required for this overshoot to settle. This means that the overshoot of the pulse signal which has occurred in the preceding measurement is not settled yet when ions are about to be ejected for the next measurement. Accordingly, a change in the measurement period causes a variation of the voltage at the point in time where the pulse signal begins to rise. This causes a fluctuation in the length of time from the point in time where the pulse signal begins to rise, to the point in time where the signal reaches the threshold voltage in the switching element. This is the cause of the aforementioned temporal fluctuation of the rising of the high-voltage pulse depending on the measurement period.

In contrast, in the time-of-flight mass spectrometer according to the present invention, the voltage applied between the two ends of the primary winding of the transformer is not fixed but controllable by the primary-side power supply. The controller controls the primary-side power supply according to the measurement period of the measurement to be performed, so as to change the voltage between the two ends of the primary winding of the transformer. While the voltage between the two ends of the primary winding of the transformer is constant, the height of the pulse signal to be applied to the control terminal of the switching element is also constant. When the voltage between the two ends of the primary winding of the transformer is changed, the height of the pulse signal to be applied to the control terminals of the switching element is changed. In other words, when the voltage at the point in time where the pulse signal begins to rise changes as a result of a change in the measurement period, the voltage at which the rising phase is completed is also changed. By this control, the gradient of the rising slope changes according to the measurement period, allowing the slope to be adjusted so that it crosses the threshold voltage in the switching element at approximately the same timing irrespective of the measurement period. As a result, if there is a variation of the measurement period, i.e., if there is a variation of the voltage at the point in time where the pulse signal applied to the control terminal of the switching element begins to rise, the temporal fluctuation of the rising of the high-voltage pulse can be suppressed.

As one mode of the time-of-flight mass spectrometer according to the present invention, the controller may include a storage section for storing information showing the relationship between a plurality of values of the measurement period and the voltage to be applied between the two ends of the primary winding of the transformer, and control the primary-side power supply based on the information stored in the storage section.

According to the configuration, the voltage to be applied corresponding to the measurement period can be directly determined with reference to the information previously stored in the storage section. This simplifies the configuration of the device. Typically, the information stored in the storage section can be experimentally obtained by a manufacturer of the device.

It is not always necessary to previously determine the voltage to be applied for every value of the measurement period that may possibly be used in the present device. It may be sufficient to previously determine the voltage for at least two values of the measurement period, and store information showing their relationship in the storage section. When a measurement using a measurement period different from the at least two values is performed, the voltage which corresponds to the measurement period concerned can be calculated by interpolation, extrapolation, or similar mathematical estimation based on the information retrieved from the storage section. This minimizes the amount of information to be stored in the storage section.

It should be noted that the time-of-flight mass spectrometer according to the present invention can be applied to any type of time-of-flight mass spectrometer in which ions are accelerated and sent into a flight space by an electric field formed by applying a high-voltage pulse to an electrode. Specifically, the present invention can be applied not only to an orthogonal acceleration time-of-flight mass spectrometer, but also to an ion-trap time-of-flight mass spectrometer in which ions held in an ion trap are accelerated and sent into a flight space, or a time-of-flight mass spectrometer in which ions generated from a sample by a matrix assisted laser desorption/ionization (MALDI) ion source or similar ion source are accelerated and sent into a flight space.

Advantageous Effects of the Invention

In the time-of-flight mass spectrometer according to the present invention, the timing of the application of the high-voltage pulse to an electrode for ejecting ions can be constantly maintained even when the measurement period of a repetitive measurement is changed. As a result, high mass accuracy can be achieved irrespective of the measurement period.

BRIEF DESCRIPTION OF DRAWINGS

FIG. 1 is a schematic configuration diagram showing an OA-TOFMS according to one embodiment of the present invention.

FIGS. 2A-2E are waveform charts showing the voltages in the main components of an acceleration voltage generator of the OA-TOFMS according to the present embodiment.

DESCRIPTION OF EMBODIMENTS

An OA-TOFMS according to one embodiment of the present invention is described as follows, with reference to the attached drawings.

Figure 3:
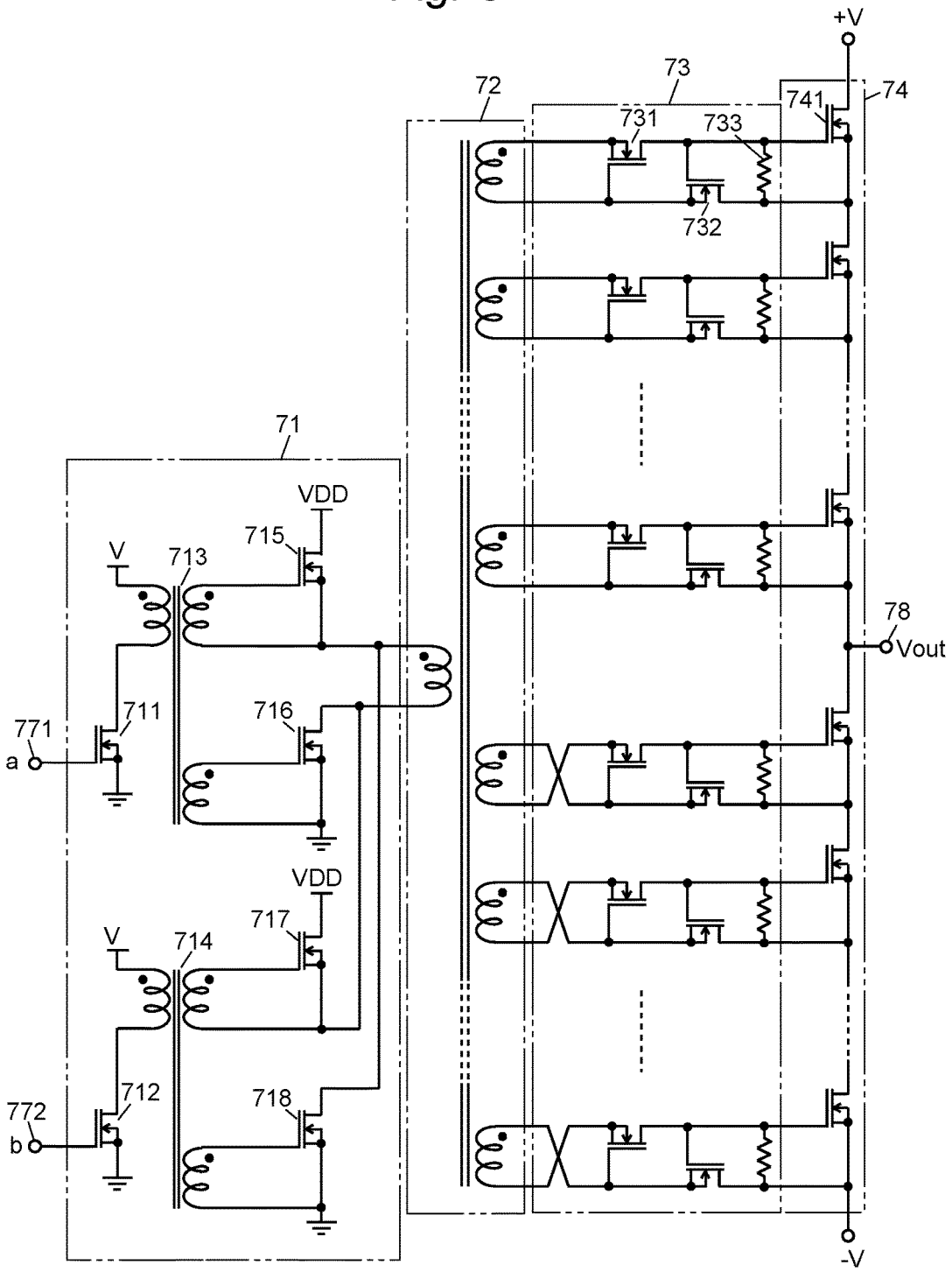
FIG. 3 is a schematic diagram showing a circuit configuration of the acceleration voltage generator in the OA-TOFMS according to the present embodiment.
Figure 14:
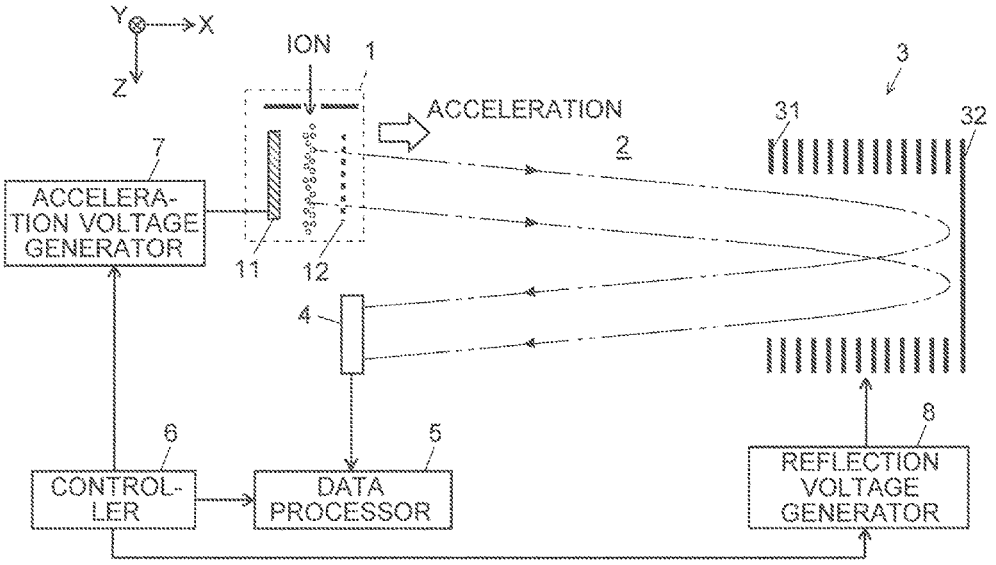
FIG. 14 is a schematic configuration diagram of a typical OA-TOFMS.

FIG. 1 is a schematic configuration diagram showing the OA-TOFMS according to the present embodiment, and FIG. 3 is a schematic diagram showing the circuit configuration of an acceleration voltage generator. Structural components which are identical to those already described and shown in FIG. 14 are denoted by the same numerals as used in FIG. 14, and detailed descriptions of those components will be omitted. The data processor 5 depicted in FIG. 14 is omitted from FIG. 1 to avoid too much complexity.

In the OA-TOFMS according to the present embodiment, the acceleration voltage generator 7 includes: a primary-side drive section 71; a transformer 72; a secondary-side drive section 73; a switch section 74; a high-voltage power supply 75; and a primary-side power supply 76. The controller 6 includes a primary-side voltage controller 61, and a primary-side voltage setting table 62.

As shown in FIG. 3, the switch section 74 in the acceleration voltage generator 7 has a configuration in which power MOSFETs 741 are serially connected in multiple stages (seven stages in this embodiment) in both the positive side (above the voltage output terminal 78 in FIG. 3) and the negative side (below the voltage output terminal 78 in FIG. 3). The voltage +V or −V applied between the two ends of the switch section 74 from the high-voltage power supply 75 is changed according to the polarity of the target ions. For example, when the polarity of the ions is positive, +V=2500V and −V=0V. The transformer 72 is a ring-core transformer. One ring core is provided for the gate terminal of the MOSFET 741 in each of the multiple stages (i.e., 14 ring cores are provided). The secondary winding wound on each of the ring cores is connected to the MOSFETs 731 and 732 in the secondary-side drive section 73. The primary winding is a single turn of cable passed through all ring cores. For the cable, a high-voltage insulated wire is used, which electrically insulates the primary side from the secondary side. The number of turns of the secondary winding may be any number.

The primary-side drive section 71 includes a plurality of MOSFETs 711, 712 and 715 to 718, and a plurality of transformers 713 and 714. The primary-side drive section 71 further includes a positive-side pulse signal input terminal 771 and a negative-side pulse signal input terminal 772, from which pulse signals a and b are respectively inputted. As shown in FIGS. 2A and 2B, while the voltage of the pulse signal b fed to the negative-side pulse signal input terminal 772 is at the level of zero, the pulse signal a at the high level is fed to the positive-side pulse signal input terminal 771 at time t0, whereupon the MOSFET 711 is turned on. As a result, electric current flows in the primary winding of the transformer 713, inducing a predetermined voltage between the two ends of the secondary winding. Thus, the MOSFETs 715 and 716 are both turned on. Meanwhile, the MOSFET 712 stays in the off-state, and no current flows in the primary winding of the transformer 714. Accordingly, the MOSFETs 717 and 718 both stay in the off-state. Accordingly, a voltage of about VDD is applied between the two ends of the primary winding of the transformer 72, and the current flows in this primary winding downwards in FIG. 3.

This induces a predetermined voltage between the two ends of each of the secondary windings in the transformer 72. In this situation, the voltage applied to the gate terminal of each of the MOSFETs in the switch section 74 via the MOSFETs 731 and 732, and a resistor 733 included in the secondary-side drive section 73 is roughly expressed by the following formula:

$$[\text{gate voltage}] \approx \{[\text{primary-side voltage of transformer } 72]/[\text{the number of serial stages of MOSFETs } 741 \text{ in switch section } 74]\} \times [\text{the number of turns of secondary winding in transformer } 72] \quad (1)$$

For example, when the primary-side voltage (VDD) of the transformer 72 is 100V, the number of serial stages of the MOSFETs 741 in the switch section 74 is 14, and the number of turns of the secondary winding of the transformer 72 is two, a voltage which is approximately equal to $(100/14)\times 2=14$V is applied to the gate terminal of each of the MOSFETs 741 in the switch section 74.

In the positive side of the switch section 74, the above voltage applied in the forward direction between the gate terminal and the source terminal of each of the seven MOSFETs 741, so that these MOSFETs 741 are turned on. By comparison, in the negative side of the switch section 74, the above voltage is applied in the reverse direction between the gate terminal and the source terminal of each of the seven MOSFETs 741, so that these MOSFETs 741 are turned off. As a result, the voltage-supplying terminal of the high-voltage power supply 75 is almost directly connected to the voltage output terminal 78. Thus, an output voltage of +V=+2500V appears at the voltage output terminal 78.

When the level of the pulse signal a fed to the positive-side pulse signal input terminal 771 is changed to the low level (voltage zero) at time t1, the voltage between the two ends of the primary winding of the transformer 72 becomes zero. However, the voltage applied to the gate terminal of each of the MOSFETs 741 is maintained by the secondary-side drive section 73 and the gate input capacitance C of the MOSFET 741. With this, the output voltage from the voltage output terminal 78 is maintained at +V=+2500V. At a later point in time t2, the pulse signal b fed to the negative-side pulse signal input terminal 772 is changed to the high level. This time, the MOSFET 712 is turned on. Along with this, the MOSFETs 717 and 718 are turned on, whereupon a voltage in the opposite direction to the previous case is applied between the two ends of the primary winding of the transformer 72. Thus, the current flows in the reverse direction. With this, a voltage is induced between the two ends of each secondary winding of the transformer 72 in the opposite direction to the previous case. Thus, the MOSFETs 741 on the positive side of the switch section 74 are turned off, whereas the MOSFETs 741 on the negative side are turned on. Accordingly, the output voltage from the voltage output terminal 78 becomes zero.

The acceleration voltage generator 7 generates a high-voltage pulse with the previously described operations at a timing corresponding to the pulse signals a and b fed to the positive-side pulse signal input terminal 771 and the negative-side pulse signal input terminal 772. However, the following problems occur in this circuit.

Figure 4:
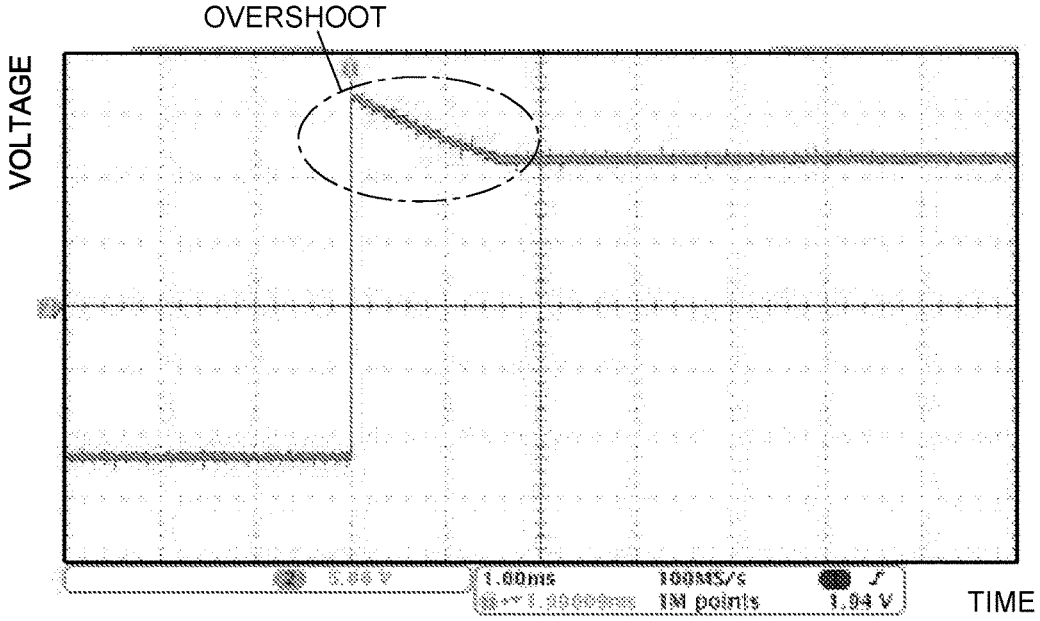
FIG. 4 is a graph showing a measured waveform of the gate voltage (during a change from a negative voltage to a positive voltage) in a MOSFET for turning on and off a high voltage.
Figure 5:
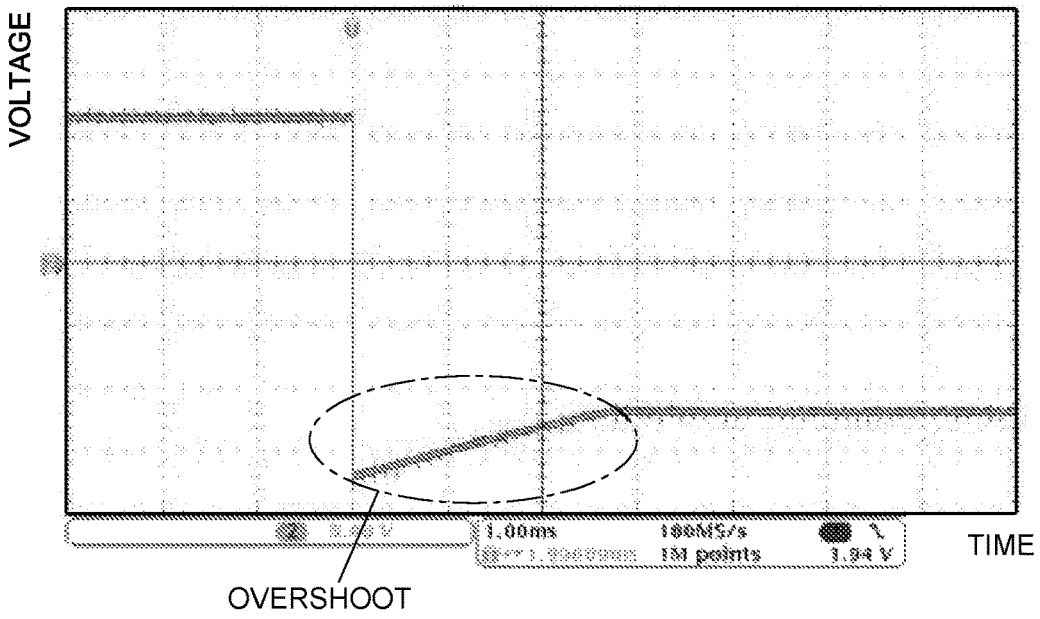
FIG. 5 is a graph showing a measured waveform of the gate voltage (during a change from a positive voltage to a negative voltage) in the MOSFET for turning on and off the high voltage.

FIGS. 4 and 5 are graphs each showing a measured waveform of the gate voltage in a MOSFET 741 in the switch section 74. FIG. 4 shows the waveform during a change from a negative voltage to a positive voltage (at time t0 in FIG. 2C). FIG. 5 shows the waveform during a change from a positive voltage to a negative voltage (at time t2 in FIG. 2C).

In the circuit on the secondary side of the transformer 72, a resonance occurs in an LC circuit that includes the leakage inductance L of the transformer 72 and the gate input capacitance C of the MOSFETs 741 in the switch section 74. This causes an overshoot in both the rising and falling phases of the gate voltage, as shown in FIGS. 4 and 5. The voltage (absolute value) which has overshot gradually decreases with the passage of time, and eventually settles to a predetermined voltage. The time required for the settling of the voltage which have overshot is at a level of several ms.

The aforementioned timing of the rise/fall of the high-voltage pulse is determined by the timing of the turning on/off of the MOSFETs 741 in the switch section 74, i.e., the timing of the rise/fall of the gate voltage of the MOSFETs 741. In the case of the waveforms shown in FIGS. 2A-2E, for example, the timing at which the high-voltage pulse changes from −V to +V shown in FIG. 2E is determined by both the timing at which the gate voltage of the MOSFETs 741 on the positive side (see FIG. 2C) changes from the negative voltage to the positive voltage, and the timing at which the gate voltage of the MOSFETs 741 on the negative side (see FIG. 2D) changes from the positive voltage to the negative voltage. The threshold value of the gate voltage for the MOSFETs 741 used in this example is about 3V. For example, when the rising slope of the gate voltage crosses this threshold voltage, the MOSFETs 741 are changed from the off-state to the on-state.

Figure 6:
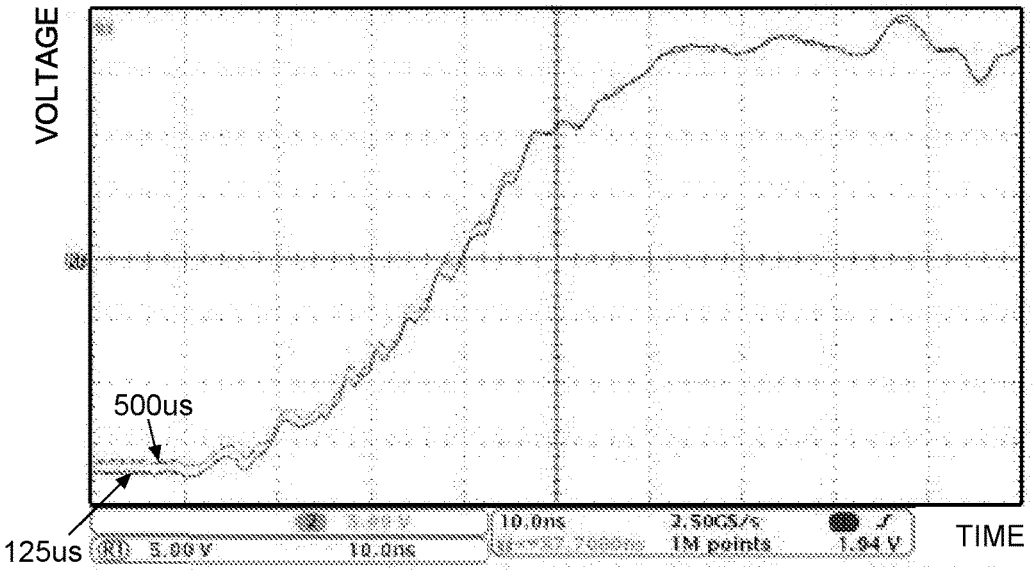
FIG. 6 is a graph showing measured waveforms of the gate voltage in the case where the rising-time correction was not performed.
Figure 7:
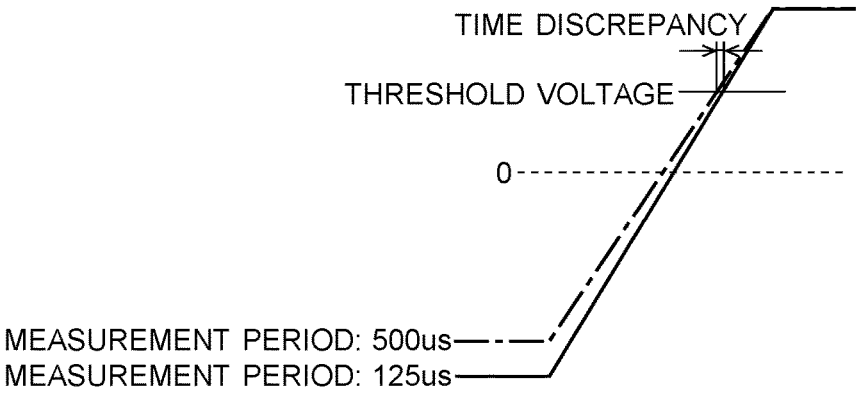
FIG. 7 is a model diagram showing the rising slopes of the voltage in FIG. 6.

In principle, the rising/falling waveform of the gate voltage should not be influenced by the measurement period of the repetitive measurement. However, in practice, a slight change in the rising/falling waveform of the gate voltage is observed when the ion ejection period is changed for changing the measurement period. FIG. 6 shows measured waveforms of the gate voltage changing from the negative voltage to the positive voltage when the measurement period was changed from 125 [μs] to 500 [μs]. FIG. 7 is a model diagram showing the rising slope of the voltage in FIG. 6.

In this example, when the measurement period is 125 [μs], the gate terminal of each of the MOSFETs 741 is charged from −17.3V to a predetermined positive voltage. When the measurement period is 500 [μs], it is charged from −16.4V to the predetermined positive voltage. In other words, the voltage at the point in time where the gate voltage begins to rise varies depending on the measurement period. This is due to the influence of the overshoot mentioned earlier. The time required for the settling of the voltage which has overshot is as much as several ms, whereas the measurement period is shorter than that by one order of magnitude. Thus, it is inevitable that the high-voltage pulse for the next measurement be generated while the voltage that has overshot as shown in FIG. 4 is still gradually decreasing (toward the target voltage). The extent of the recovery from the overshoot depends on the measurement period. This causes a variation of the voltage at the point where the gate voltage begins to rise.

Such a variation of the voltage at the point in time where the gate voltage begins to rise causes a discrepancy in the point in time at which the gate voltage reaches the threshold voltage, as shown in FIG. 7. Accordingly, a discrepancy occurs in the timing of the turning on and off of the MOSFETs 741, causing a discrepancy in the timing of the rising of the high-voltage pulse. Specifically, in this case, when the measurement period is 500 [μs], the gate voltage reaches the threshold voltage earlier than in the case where the measurement period is 125 [μs], so that the high-voltage pulse begins to rise earlier.

Figure 8:
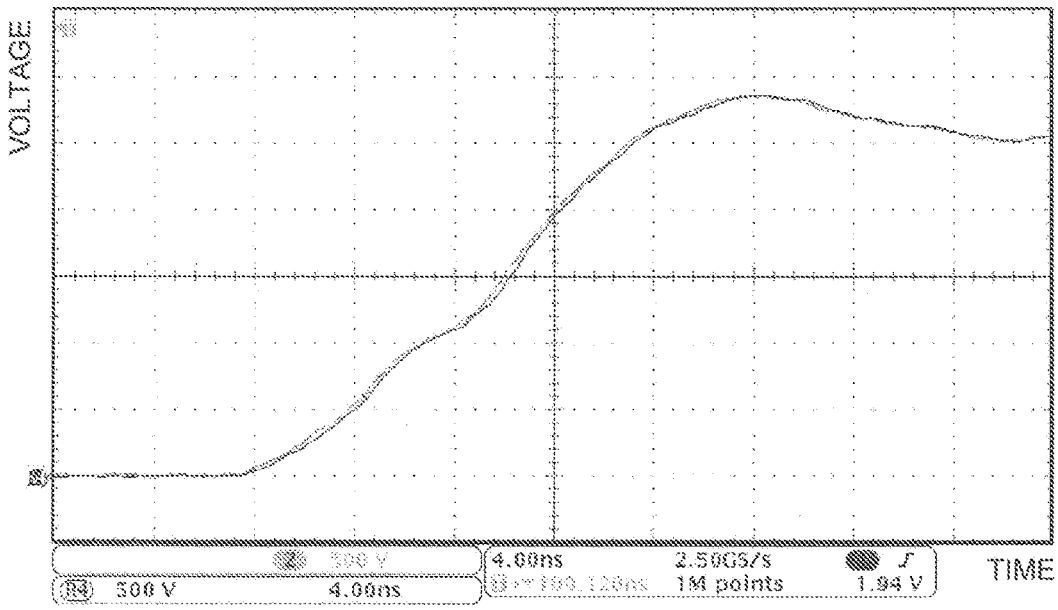
FIG. 8 is a graph showing measured waveforms of an output voltage in the case where the rising-time correction was not performed.
Figure 9:
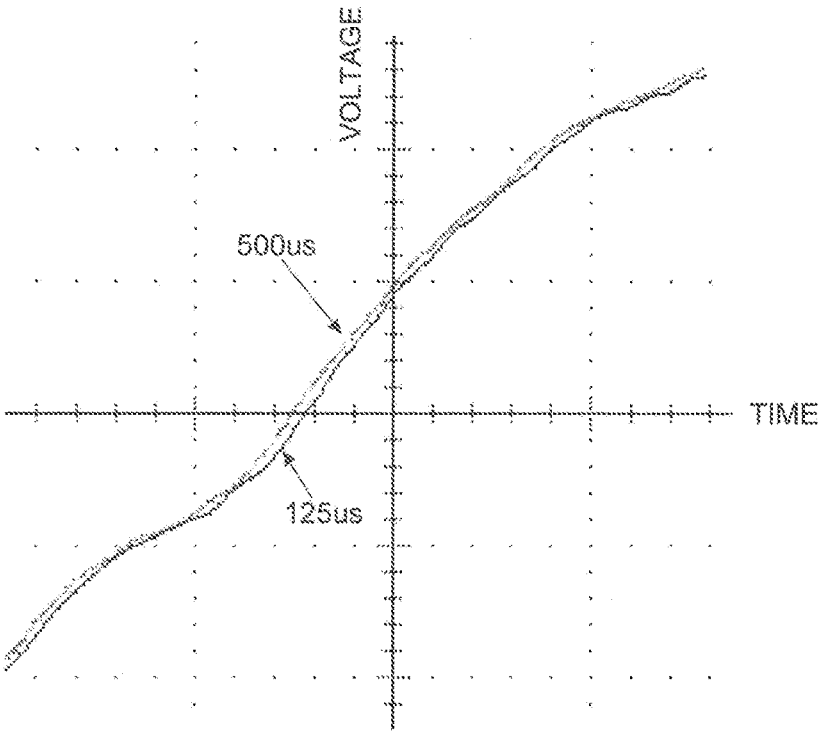
FIG. 9 is a partially enlarged view of the graph shown in FIG. 8.

FIG. 8 is a graph showing measured waveforms of the output voltage of the high-voltage pulse. FIG. 9 is a partially enlarged view of the graph shown in FIG. 8. In the example shown in FIGS. 8 and 9, a time discrepancy of 350 [μs] occurs between the two cases having the measurement periods of 125 [μs] and 500 [μs]. This time discrepancy corresponds to a mass discrepancy of about 10 [ppm] for m/z=1000. A precise mass measurement requires the mass discrepancy to be no greater than approximately 1 [ppm]. A mass difference of 10 [ppm] is impermissible in precise mass measurements.

In view of the above, the OA-TOFMS according to the present embodiment resolves the time discrepancy in the waveform of the output voltage between the measurements performed with different measurement periods by the following method, and thus enhances the mass accuracy.

In the example described with reference to FIGS. 6 and 7, the high-level voltage value of the gate voltage is constant regardless of the measurement period. In contrast, in the OA-TOFMS according to the present embodiment, the high-level voltage value of the gate voltage is changed depending on the measurement period in such a manner that the timing at which the gate voltage reaches the threshold voltage is made to be substantially the same even when there is a variation of the voltage at the point in time where the the gate voltage begins to rise. According to formula (1), the voltage value of the gate voltage may be changed by changing the number of serial stages of the MOSFETs 741 in the switch section 74 or the number of turns of the secondary winding of the transformer 72. However, it is difficult to change these numbers. Accordingly, in the present embodiment, the voltage value of the gate voltage is changed by changing the primary-side voltage of the transformer 72 according to the measurement period.

Figure 10:
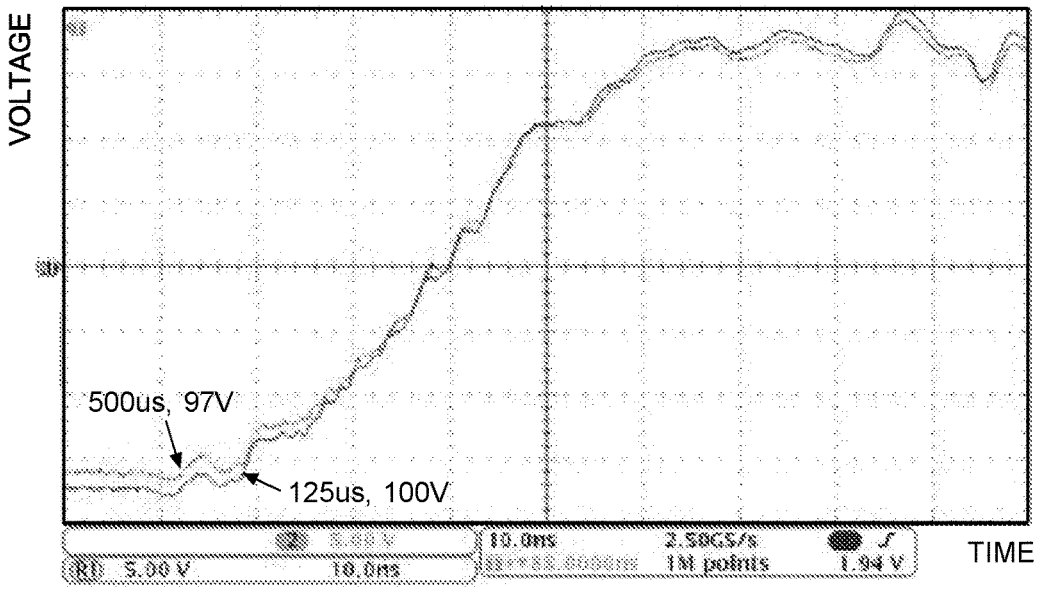
FIG. 10 is a graph showing measured waveforms of the gate voltage in the case where the rising-time correction was performed.
Figure 11:
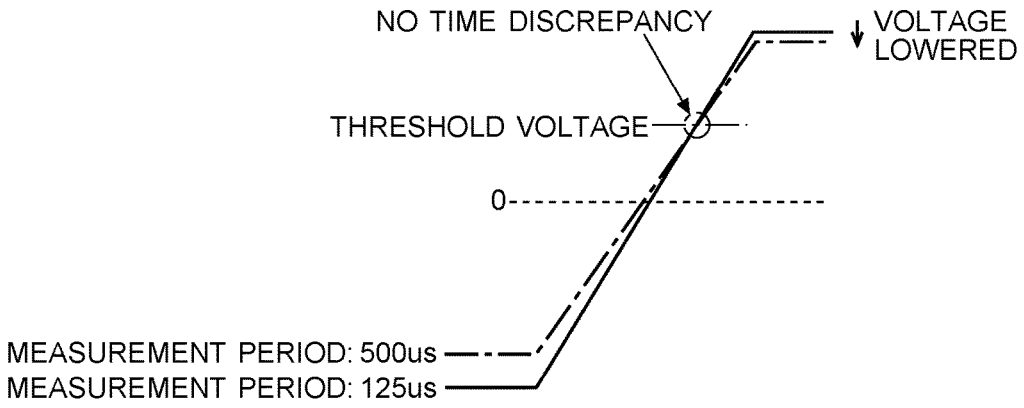
FIG. 11 is a model diagram showing the rising slopes of the voltage in FIG. 10.

FIG. 10 shows measured waveforms of the gate voltage changing from a negative voltage to a positive voltage in the case where the measurement period was 125 [μs] and the primary-side voltage in the transformer 72 was 100V, as well as in the case where the measurement period was 500 [μs] and the primary-side voltage in the transformer 72 was 97V. FIG. 11 is a model diagram showing the rising slopes of the voltage in FIG. 10. When the measurement period is 500 [μs], the absolute value of the negative voltage at the point in time where the gate voltage begins to rise is smaller than in the case where the measurement period is 125 [μs], whereas the gradient of the rising slope is gentler due to the lower setting of the high-level voltage value of the gate voltage. As a result, the timing at which the gate voltage reaches the threshold voltage is made to be almost the same in both cases with the measurement periods of 125 [μs] and 500 [μs], whereby the time discrepancy is corrected. Accordingly, the timing at which the MOSFETs 741 in the switch section 74 are turned on and off does not change depending on the measurement period.

Figure 12:
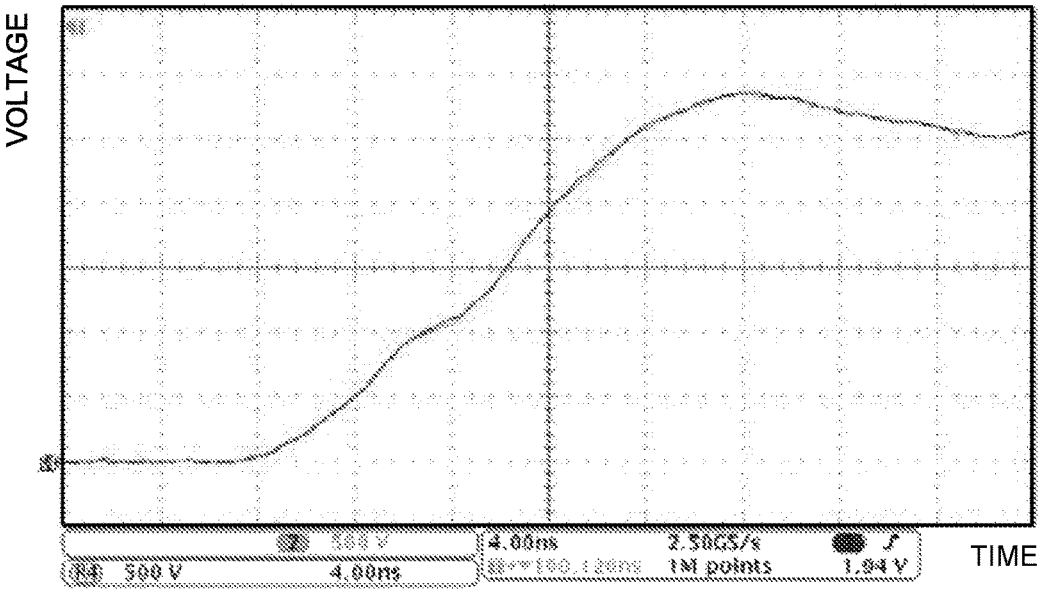
FIG. 12 is a graph showing measured waveforms of the output voltage in the case where the rising-time correction was performed.
Figure 13:
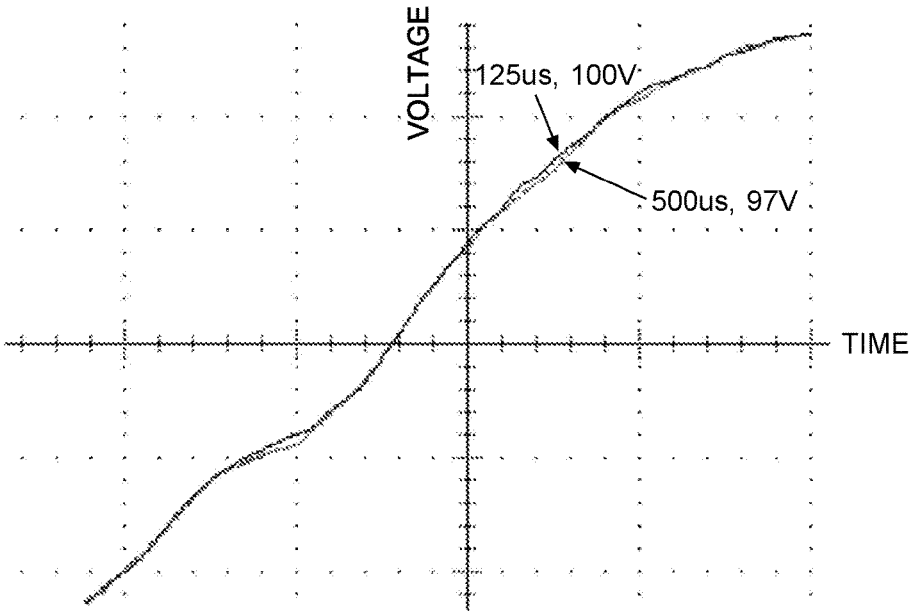
FIG. 13 is a partially enlarged view of the graph shown in FIG. 12.

FIG. 12 shows measured waveforms of the output voltage of the high-voltage pulse in the present example. FIG. 13 is a partially enlarged view of the graph shown in FIG. 12. In the example shown in FIGS. 12 and 13, it can be confirmed that the time discrepancy between the two cases with the measurement periods of 125 [μs] and 500 [μs] has been almost completely resolved.

As just described, it is possible to experimentally determine beforehand the relationship between the measurement period and the primary-side voltage suitable for resolving the time discrepancy in the high-voltage pulse. In view this, in the OA-TOFMS according to the present embodiment, this relationship is stored in the primary-side voltage setting table 62 beforehand, as shown in FIG. 1. This relationship is highly reproducible once the configuration of the device is fixed. Therefore, the manufacturer can experimentally determine and prepare such a relationship.

In an actual measurement, the primary-side voltage controller 61 in the controller 6 reads the information showing the aforementioned relationship from the primary-side voltage setting table 62, and calculates the primary-side voltage corresponding to the measurement period for a measurement which is about to be performed, based on that information. If the measurement period is 125 [μs] or 500 [μs], the read information can be directly used. If the measurement period is different from 125 [μs] or 500[μs], for example 250 [μs], the primary-side voltage corresponding to the measurement period concerned should be calculated by mathematical estimation using linear interpolation or extrapolation. Specifically, the primary-side voltage for a measurement period of 250 [μs] may be set to 99V, for example. The controller 6 informs the primary-side power supply 76 of the calculated primary-side voltage. The primary-side power supply 76 generates the specified direct-current voltage and applies it to the primary-side drive section 71 as VDD. The voltage applied to the primary winding of the transformer 72 is thereby adjusted according to the measurement period of the newly-performed measurement, and the high-voltage pulse with no time discrepancy is generated and applied to the push-out electrode 11 and the extraction electrode 12. As a result, a high level of mass accuracy can always be achieved without being influenced by the measurement period.

The aforementioned embodiment is merely an example of the present invention, and any change, addition, or modification appropriately made within the spirit of the present invention will naturally fall within the scope of claims of the present application.

For example, as opposed to the previous embodiment, in which the present invention is applied to an OA-TOFMS, the present invention can be applied to other types of time-of-flight mass spectrometer, such as an ion trap time-of-flight mass spectrometer in which ions held in a three-dimensional quadrupole ion trap or linear ion trap are accelerated and sent into a flight space, or a time-of-flight mass spectrometer in which ions generated from a sample in a MALDI or similar ion source are accelerated and sent into a flight space.

REFERENCE SIGNS LIST

1 . . . Ion Ejector
11 . . . Push-Out Electrode
12 . . . Extraction Electrode
2 . . . Flight Space
3 . . . Reflector
31 . . . Reflection Electrode
32 . . . Back Plate
4 . . . Detector
5 . . . Data Processor
6 . . . Controller
61 . . . Primary-Side Voltage Controller
62 . . . Primary-Side Voltage Setting Table
7 . . . Acceleration Voltage Generator
71 . . . Primary-Side Drive Section
711, 712, 715 To 718, 731, 732, 741 . . . MOSFET
72, 713 . . . Transformer
73 . . . Secondary-Side Drive Section
733 . . . Resistor
74 . . . Switch Section
75 . . . High-Voltage Power Supply
76 . . . Primary-Side Power Supply
8 . . . Reflection Voltage Generator

The invention claimed is:

1. A time-of-flight mass spectrometer which repeats a measurement covering a predetermined time-of-flight range with a predetermined period, the time-of-flight mass spectrometer comprising:

a) an ion ejector for ejecting ions to be analyzed into a flight space by imparting acceleration energy to the ions by an effect of an electric field created by a voltage applied to an electrode;

b) a high-voltage pulse generator for applying, to the electrode of the ion ejector, a high-voltage pulse for ejecting ions, the high-voltage pulse generator including: a direct-current power supply for generating a high direct-current voltage; a transformer including a primary winding and a secondary winding; a primary-side drive circuit section for supplying drive current to the primary winding of the transformer in response to an input of a pulse signal for ejecting ions; a secondary-side drive circuit section connected to the secondary winding of the transformer; a switching element to be driven by the secondary-side drive circuit section to turn on and off for generating a voltage pulse from the high direct-current voltage generated by the direct-current power supply; and a primary-side power supply for generating a voltage to be applied between two ends of the primary winding of the transformer through the primary-side drive circuit section; and c) a controller for controlling the primary-side power supply to change the voltage to be applied between the two ends of the primary winding of the transformer in the high-voltage pulse generator, according to a measurement period of a measurement to be performed.

2. The time-of-flight mass spectrometer according to claim 1, wherein:

the controller includes a storage section for storing information showing a relationship between a plurality of values of the measurement period and the voltage to be applied between the two ends of the primary winding of the transformer, and controls the primary-side power supply based on the information stored in the storage section.

3. The time-of-flight mass spectrometer according to claim 2, wherein:

the voltage to be applied is determined for at least two values of the measurement period, and information showing the relationship between the voltage and the at least two values of the measurement period is stored in the storage section; and when a measurement using a measurement period different from the at least two values is performed, the controller calculates the voltage to be applied corresponding to the measurement period concerned, by mathematical estimation based on the information retrieved from the storage section.

* * * * *